US006490737B1

(12) United States Patent
Mazzei et al.

(10) Patent No.: US 6,490,737 B1
(45) Date of Patent: Dec. 10, 2002

(54) PROTECTIVE CUSHION AND COOPERATIVELY ENGAGEABLE HELMET CASING FOR ANESTHETIZED PATIENT

(75) Inventors: William Mazzei, San Diego, CA (US); Gregory P. Jordan, Carlsbad, CA (US); An P. Vu, Vista, CA (US)

(73) Assignee: Dupaco, INC, Oceanside, CA (US)

( * ) Notice: Subject to any disclaimer, the term of this patent is extended or adjusted under 35 U.S.C. 154(b) by 0 days.

(21) Appl. No.: 09/545,794

(22) Filed: Apr. 9, 2000

Related U.S. Application Data

(63) Continuation-in-part of application No. 09/080,975, filed on May 19, 1998.

(51) Int. Cl.[7] ..... A42B 3/00; A47C 20/00

(52) U.S. Cl. ..... 2/410; 2/9; 5/638; 5/640; 128/846

(58) Field of Search ..... 2/9, 11, 410, 411, 2/414, 417, 424; 128/845, 846, 857, 858; 5/638, 639, 640, 643, 622; 602/17

(56) References Cited

U.S. PATENT DOCUMENTS

| | | | | | |
|---|---|---|---|---|---|
| 4,752,064 | A | * | 6/1988 | Voss | 5/622 |
| 5,269,035 | A | * | 12/1993 | Hartunian | 5/637 |
| 5,520,623 | A | * | 5/1996 | Williams | 128/857 |
| 5,613,501 | A | * | 3/1997 | Michelson | 5/637 |
| 5,960,494 | A | * | 10/1999 | Gilliland et al. | 5/638 |

* cited by examiner

*Primary Examiner*—Rodney M. Lindsey
(74) *Attorney, Agent, or Firm*—Donn K. Harms

(57) ABSTRACT

A protective helmet apparatus of modular construction to be worn by anesthetized patients for facial support during surgery. The helmet apparatus is assembled using one of a plurality of interchangeable, substantially transparent helmet casings, which are removably attachable to a plurality of dismountable facial cushions providing even support to the facial surface of a patient. The removable facial cushions are dimensioned on and interior surface to accommodate different sized facial structures of different patients to yield maximum pressure diffusion on the face and chin of the patient and are replaceable when worn. The exterior surface of the facial cushions are dimensioned for cooperative engagement with the interior surface of the helmet casing. A plurality of different facial cushions and helmet casings are modular in design and dimension to be interchangeable with each other thus providing accommodate the broad differences in facial structure and size of patients using them for surgery. The cushions may be marked with printed or color coded indicia to designate size. A view of the patients eyes and surrounding area is afforded through in line ocular apertures extending around a front surface area and up at least one sidewall. The ocular aperture is in line with a cushion ocular aperture when the cushion is engaged with the casing thereby allowing a view of the patent eye and surrounding face through the ocular aperture from the side of the device. Additional utility is provided by variable elevation above a registered engagement with a mount which also may provide a mirrored surface to reflect the patent facial features for viewing by upright doctors and operating staff. An optional integral heating element aids in temperature control of the patient's head during surgery.

23 Claims, 5 Drawing Sheets

PROTECTIVE CUSHION AND COOPERATIVELY ENGAGEABLE HELMET CASING FOR ANESTHETIZED PATIENT

This is a continuation-in-part of application Ser. No. 09/080,975, filed May 19, 1998.

BACKGROUND OF THE INVENTION

1. Field of the Invention

The present invention relates to a safety helmet for cranial protection. More particularly it relates to a modular helmet apparatus constructed of interchanging cooperative components of differing sizes which provide a prophylactic cushion and helmet to be worn by patients undergoing general anesthesia to prevent eye, skin, or other nerve damage from prolonged pressure upon areas of the head as well as to provide a safer manner for cranial manipulation during surgery.

2. Prior Art

Surgeries upon patients in the prone position present a number of patient care challenges to the anesthesiologist and surgical staff. Once a patient undergoing a surgery requiring general anesthesia is anesthetized, that patient is essentially in a coma like state. In such a state, noxious stimuli to the patient's body and skin, such as pressure or pain, which would normally cause an awake patient to move to relieve the stimulus, no longer causes such a reaction. Consequently, patients under general anesthesia are especially threatened by a number of factors, other than the surgery itself, which arise during such surgical procedures.

One hazard which requires constant vigilance by the surgical staff to protect against injury is the threat of eye damage. Inadvertent pressure upon the ocular structures of a patient for just a matter of minutes can cause extreme damage or blindness to the eye. As noted above, because the anesthetized patient is in a coma like state, the discomfort of facial compression upon the eye, which would normally cause an awake patient to move and relieve that pressure, fails to alert the anesthetized patient. Care must be taken by an ever alert surgical staff to inspect for possible pressure points about the ocular structures of the patient and to move the patient's face to prevent eye damage.

Other compression injuries can occur to the anesthetized patent's forehead and chin areas. Here again, the constant pressure upon those areas, caused by the weight of the patients own head, if not relieved by movement of the face to allow blood flow thereto, can cause localized ischemia to the chin and forehead area. Since the anesthetized patient does not react to the body's cues of discomfort preceding injury, the risk of harm in a matter of minutes to these areas is great.

An additional concern during surgical procedures of the anesthetized patient is the decrease in body temperature that can occur during surgery. Currently bulky warmed towels and electric blankets are used in an attempt to warm the patient. Such endeavors crowd the operating field and are not easily controlled for temperature.

Currently, there are a number of conventional methods to support the head and protect the eyes and face of a patient from compression injuries during surgery which require the patient to be placed in a prone, face down, position for the long periods of time involved in surgery. One method conventionally used is placement of the patient's head and face in a horseshoe shaped frame supporting a foam pillow which holds the patients face off of the operating table in a supported manner. The patient's eyes are generally taped shut when such a structure is used to keep them from contact with the foam and to prevent eye fluid drainage. This frame and pillow support however has inherent hazards of its own in that it cannot distribute pressure maximally over the surface of the head. Further, great care must be taken by the anesthesiologist and staff to make sure that any anesthetic equipment, such as endotracheal tubes, esophageal stethoscopes, or electronic sensing devices, are not dislodged or disrupted by gravity or patient positioning during the term of the surgical procedure. Such disruption or dislodgement of surgical equipment can cut off the air supply to the patient or lead to inaccurate readings by monitoring equipment.

Another method is simply to place the patient's face sideways on a pillow or towel located upon the surgical table. However, this method suffers from the danger of tubing collapse due to the patient's head weight, and even a face or eye supported by a foam pillow may be damaged if the pressure is uneven and remains on one area too long. Further, the placement of the patient's face on a towel requires the head to be turned one way or the other, placing pressure on one side of the face which, as noted earlier, subjects the patient to the potential of injury. Additionally, blood flow through the veins and arteries of the neck may be impaired by this twisted fashion of head support. Hazards to the patient increase if the surgery requires a face down posture because the danger of tube collapse from pressure or bending increases with the tubes entering the patient's body through the mouth or nose being compressed between the patient's face and the operating table. With the entry points to the head out of view, such constrictions of the tubes also remain out of sight.

A further challenge facing surgical teams during surgery on anesthetized patients is the seemingly simple task of rolling the patient over from a supine position to a prone position on the operating table or from a cart onto the operating table. Generally, the patient at this point in the surgical procedure is already intubated, asleep, and basically "dead weight." In this physical state, the patient is at great risk of injury during the roll over procedure, especially to the neck area. Additionally vexing to the surgical staff is the fact that the patient, with tubes exiting the mouth and/or nose, must be rolled over, without disturbing the tubes and without injuring the neck. Concurrently during the roll over procedure, the surgical staff must plan ahead so that when the patient is placed face down on an operating table, the face is properly aligned with, and inserted upon or into the pillow, already located upon the table. This insertion of the face into the pillow is conventionally done without the benefit of a pre surgery fit to make sure the face and pillow and frame mate in a manner that will accommodate the patient for the term of the surgery and protect the face from compression injury. Heads and faces being quite different amongst people in general, an optimum fit between face and pillow is achieved only a small percentage of the time. Once in this prone position, the danger of injury remains constant and continued and consistent vigilance by the surgical staff is required to ascertain, that in fact, the patient's airways are open, the eyes are not compressed, and the face is not being subjected to pressure at any point for a duration sufficient to cause nerve damage.

Finally, when the operation is over, the patient must again be moved off of the operating table and is generally rolled over onto a gurney in a reverse roll over procedure. Still anesthetized, the patient is at great risk of injury to the neck if the head is not adequately supported and manipulated during this roll over process.

Still further, if an emergency develops while the patient is in the face down prone position, requiring the patient to be rolled to the supine position, valuable life saving time can be lost trying to upright the patient without injury to the neck, and without crimping the airway supply tubing and monitoring equipment communicating through the nose and mouth of the patient.

Further, patient size is also a factor in the fitting of facial and head support. A child may have a very small face and head and an adult a large one. Conversely, a large child may have a head and face requiring support in areas much different from a small stature adult.

U.S. Pat. No. 5,220,699 (Farris) teaches an inflatable pillow mounted inside a mask for variable support of differing sized patients. However Farris requires the use of an inflatable chamber which as taught is inflated once the patient has already been rolled to the prone position. It requires an air inflation device to function and lacks the ability for an easy installation prior to surgery and will not function without compressed air.

U.S. Pat. No. 4,400,820 (O'Dell) teaches an apparatus using pads and having a "T" shaped void which may be used in combination with a support structure to hold the patient's head. However, O'Dell does not allow for pre-fitting and pre-installing the protective device prior to surgery and does not aid in protecting the patient during roll over on and off the table.

U.S. Pat. No. 5,214,815 (Agbodoe) teaches a surgical headrest with a removable foam pad; however, Agbodoe does not provide any manner to pre-fit and install the device on the patient prior to being asleep and it mounts to the table and is intended for use after roll over thereon.

U.S. Pat. No. 4,757,983 (Ray) features a pair of cushions attached to a horseshoe-shaped frame for surgical head support. However Ray also suffers from an inability to pre-fit and install the device on patients prior to surgery while they are awake as well as lacking any protective ability during dangerous roll over onto the table and like the aforementioned prior art, lacks the ability to see the patient's eyes and face from the side or from above.

As such, there exists a need for a support device that is easily modified to fit a variety of patients of differing size, and that may be pre-fit to the patient prior to surgery while the patient is alert and able to ascertain the comfort or discomfort level of the device. Further such a device should provide an additional manner to support the head and maximally diffuse pressure over a large area while helping prevent patient thermal heat loss during surgery, as well as during the hazardous movement of the patient prior to and after surgery. Such a device should also provide for easy viewing of the patient's eyes and nose from a side and top view during the operative procedure so that the patient may be continually monitored by the staff.

A further need exists for such a device that may be cooperatively engaged with a positionable mount or used by itself if needed yet still provide a view of the eyes and ocular area of the patient from looking inward from the side.

SUMMARY OF THE INVENTION

The present invention relates to a new and improved protective helmet apparatus which provided functionally through the ability to vary the configuration for the physical characteristics of patients undergoing general anesthesia during surgery, and provide optimum cranial support to the patent using differing configurations of the various parts of the device. Concurrently, the device, when using a substantially transparent helmet casing and operatively placed apertures provides the medical professionals operating on the patient, easy viewing of the patients facial features and easy access to the nasal and oral passages of the patient in either the prone or supine position. The device is best made of modular construction allowing for the substantially transparent helmet casing to fit a variety of different sized patients. Interchangeable and replaceable cushions of variable dimensions on one surface to accommodate different patient facial structures are positionaable in a plurality of interchangeable light weight helmet casings. The cushions on their exterior surface are dimensioned for a registered fit with the helmet casing surface and apertures in the cushion register with apertures in the helmet casing. The cushions can also be color coded to designate different sizes to accommodate different sized patients. If desired, while not the best mode for maximum support and positioning, the cushions themselves can be used without the helmet casing, yet still provide a side view of the patient's eyes and temple area during the procedure through an aperture communicating through a sidewall to the face of the patient. Such might be the case in emergencies when sufficient helmet casings are not available or when a low mount of the patient's head is desirable.

The device is especially useful in that it allows for pre-fitting of the patient while the patient is awake and alert using modular pads of differing facial dimensions and having a rear or mask side dimension configured to fit into a registered position in the helmet casing. While the current best mode combines the proper sized cushion with the appropriate helmet casing for a mount on the table surface, even using the facial cushion by itself, if desired, yields a substantial increase in utility over prior art due to the viewing of the patient's eyes and temple area from the side afforded by the apertures therefor. The device having the pre-fitted cushions or pads mounted into the helmet casing, and featuring appropriate indentations on the facial contact surface, evenly diffuses pressures on the face of the wearer and may be worn into surgery such that the surgical team need not worry about trying to fit the patient with pillows or pads in a table mounted frames after the patient is asleep.

For use in a variety of patients in prone or supine positions during surgery the various embodiments of the device offer a plurality of ways in which to support the patient's head. One embodiment features a hinged or optionally removable lower chin support which is moveable from a first position in operable contact with the helmet casing to a second position out of such contact, thus allowing the surgical team easy access to the entire face and mouth area for insertion of required tubing into the patients mouth and/or nose. The chin support is thereafter reinstalled to provide lower chin support with the entire helmet being worn by the patient for the rollover procedure on and off the table to protect the patient from injury during the course of the surgical procedure. Or, the chin support may be provided by the cushion itself with the cushion and the helmet casing extending below the mouth area of the patient thus eliminating the detachable chin support.

As the device may be pre-fitted for optimal weight diffusion and comfort and can be worn during the movement of the patient on and off the operating table, the surgical team is relieved on concerns of whether the device to hold the face and head actually fits the patient. Further, an optional rotating handle upon the top of the helmet provides a handy gripping point for the head for the surgical team to help prevent neck injury during roll over of the patient on and off the table. By placement of a hand on the face of the mask and another on the rotating handle, smooth and continual support may be provided to the neck and head area when the patient is being rolled over on or off of the operating table.

Another embodiment of the device features a helmet casing, which is best made of substantially transparent material, having an interior cavity that is formed to register with a cooperatively engageable cushion. The cushion is made from foam or other soft resilient material and is dimensioned on one surface to accommodate the patient's face, and on the other opposite or exterior surface, to register with the interior cavity of the helmet casing. A raised border about the exterior surface perimeter of the cushion could be formed during manufacture to provide an additional means to register and align the cushion with the openings in the helmet casing. Optionally, the cushions may be color coded for patient facial sizing. One or a plurality of apertures communicating through the helmet casing register with appropriately configured apertures communicating between the two surfaces of the cushion and provide an in line cavity from the patient's face through the casing. This in-line cavity provides access to the patient's mouth, nose, and eyes. By dimensioning the cavity to extend around the patients face at eye level, easy viewing of the patient's eyes and nose is provided to the operating room staff.

An additional embodiment of the device would feature a plurality of legs on the exterior surface of the helmet casing to provide a raised mount above the operating table. The legs can be adjustable for height above the operating table to provide comfortable posture to the patient while affording the best access and view of the face of the patient to the staff of the operating room.

In the current best mode, an optional base may also be provided which provides a releasable but solid mount for the helmet casing using cooperating fasteners located on the mount and the exterior of the helmet casing. The mount acts as a positioner by providing a stable mount for the helmet casing and optionally may provide additional utility in the best mode with a surface mounted mirror for providing a reflective view of the patient's eyes and nose to the staff of the operating room while the patient is face down and the staff is substantially in an upright position. This eliminates the constant need for members of the operating team to bend over to inspect the face and eyes of the patient during surgery in providing a continuous view of the eyes and face of the face-down patient. Additional utility is provided by an optional light means positioned on the upper surface of the mount adjacent to the mirror by illuminating the patient's face through the in-line cavity and enlightening the reflection on the mirror for the staff to more easily view it from a distance.

An object of this invention is to provide a helmet which prevents injury due to ocular compression during surgery by minimizing ischemic damages through maximal diffusion of pressure about the patient's head.

Another object of this invention is the provision of a protective device for use during surgery which allows for pre-fit of the patient prior to surgery while the patient may comment on the comfort or discomfort level of the device.

A further object of this invention is to provide a protective helmet for surgery which provides a facial and chin support to the patient which is easily removable by the surgical team for insertion of required devices into the mouth and nose of patient and thereafter easily reinstalled.

An additional object of this invention is the allowance of easy access to and viewing of, the patients eyes and temple area through apertures in the device positioned to accommodate such access and viewing.

Another object of this invention is the provision of a protective surgical helmet of modular construction which allows for positioning of different sized facial cushions and components into the helmet casing to accommodate the head different sized patients.

An additional object of this invention is providing an easily sterilized protective helmet through the use of easily sterilized cushions or inexpensive throw away insertable cushions removably mountable inside an easily sterilized or cleaned helmet shell.

A still further object of this invention is to concurrently provide easy viewing of the eyes and mouth area of the patient while the device is mounted upon the patient.

A still further object of the invention is the provision of the ability to control and alter the temperature of the device to aid in temperature control of the patient during surgery.

An additional object of this invention is to provide easy viewing of the patients facial features to the operating staff using while concurrently allows the staff members to remain substantially upright through the provision of a reflective means of the face of the patient.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
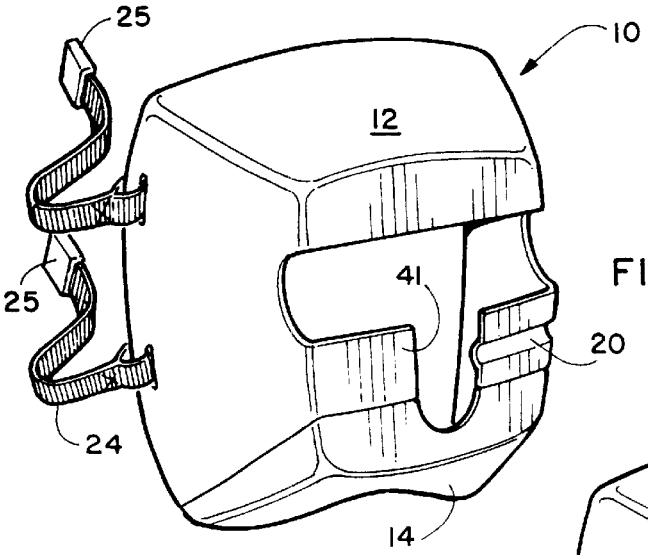
FIG. 1 is a perspective frontal view of the protective helmet device showing the chin support in a mounted position.
Figure 2:
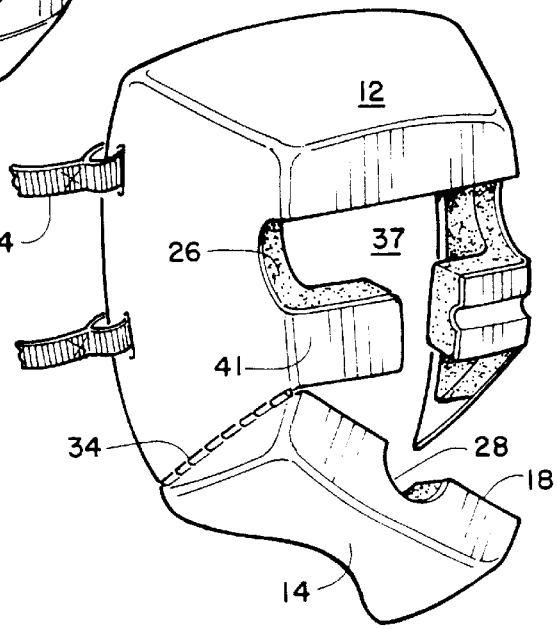
FIG. 2 is a frontal view of the device featuring the hinged repositionable chin support.
Figure 3:
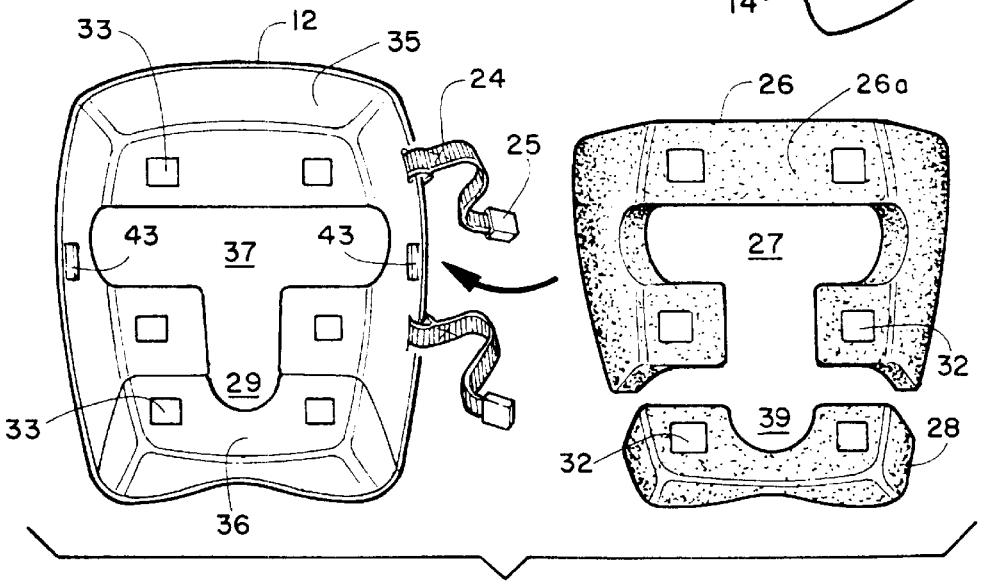
FIG. 3 is a rear exploded view of the protective helmet device showing the modular pads for the ocular area and chin support.
Figure 4:
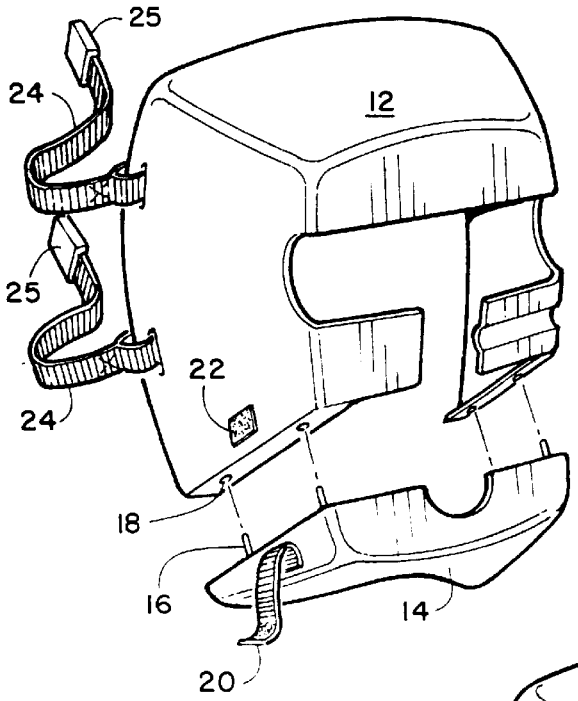
FIG. 4 shows the helmet with detachable and repositionable chin support portion.
Figure 5:
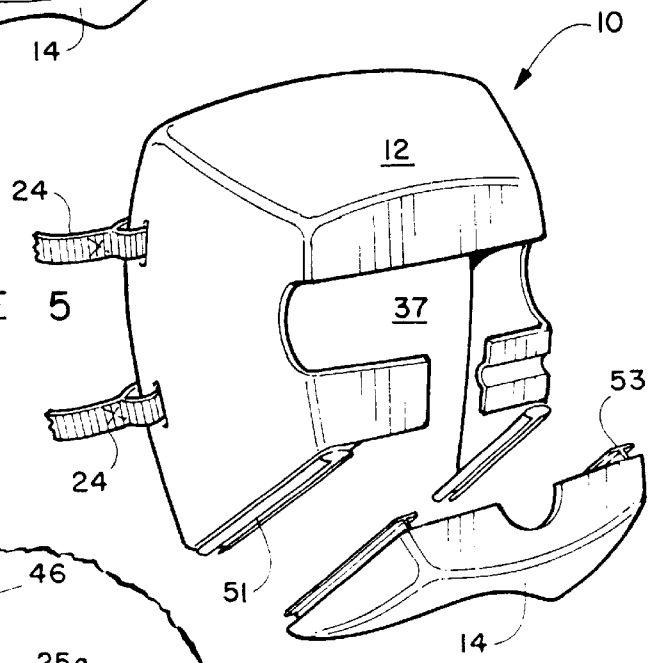
FIG. 5 depicts the helmet with detachable and repositionable chin support slidably mountable to the helmet.
Figure 6:
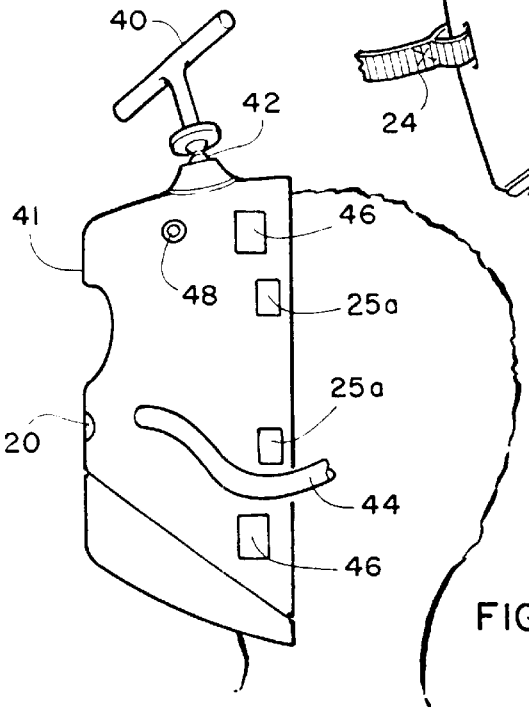
FIG. 6 depicts a side view of the apparatus showing the optional handle side grip and the flat face for secure positioning on the surgery table.

Referring now to the drawings, FIG. 1 depicts a preferred embodiment of the modularly assembled protective surgical helmet apparatus 10 featuring the helmet casing 12 which is best made from a substantially rigid but easily molded material such as plastic. The plastic casing should also be resistant to the heat or chemicals sufficient to allow for sterilization between uses. The modular version of the helmet casing 12 mates with a chin support 14 using conventional registering mating positioners such as registration pins 16 which correspond to apertures 18 upon the helmet casing 12. Of course the registration pins 16 and apertures 18 might be reversed in positioning or other conventional means of registration and dismountable attachment may be used to achieve a properly aligned mounting of the chin support 14 to the helmet casing 12. Alternatively, the chin support 14 can be slidably mounted to the helmet casing 12 using a cooperating pair of slide mounts 53 and 51 depicted in FIG. 5 wherein the chin support 14 with one half of the fastener slid mount 53 would be lined up with the helmet casing 12 and cooperating slide mounts 51 and 53 and thereupon the chin support 14 would slide onto the helmet casing 12 by pushing it into position and interfacing the cooperating slide mounts 51 and 53. Cooperating fasteners 20 and 22 in the two-piece embodiment, such as hook and loop fabric, are used to maintain the chin support 14 in operative contact in a first position wherein it is in a removably fixed position upon the helmet casing 12, however, other conventional mating fasteners such as plastic or metal releasable locking fasteners can also be used and are anticipated. Cooperating fasteners 20 and 22 would also be used to maintain the hinged chin support 14 and slidable chin support 14 in the first position of operable and registered contact with the helmet casing 12 although in the case of the slidable version friction alone in the cooperating slides may be sufficient to releasably hold the chin support 14 in proper contact with the helmet casing 12.

The dismountable chin support 14 may also be attached to the helmet casing 12 at one end using a conventional metal or plastic hinge fastener 34 such that the chin support 14 will swing away from its first position in operative contact in a registered mounting with the helmet casing 12. This embodiment allows for easy access to the patient's facial area during surgery or emergencies while maintaining the chin support attached to the helmet casing 12 when swung to the second position out of operative contact with the helmet casing so as to avoid loss of the chin support 14.

Straps 24 having cooperating fasteners 25 at their distal ends securable to mating cooperating fasteners 25*a* upon the helmet casing 12 may be optionally used to secure the helmet casing 12 upon the face of the patient once the properly sized ocular cushion 26 has been removably mounted into the helmet casing 12.

In certain instances the helmet casing and chin support might also be formed as one piece for surgeries where a removal of the chin support 14 is not a major consideration and for ease of use and reduction in parts to inventory. In such a one piece embodiment the support to the face of the patient provided by the ocular cushion 26 and chin cushion 28 would be provided by a single once piece facial cushion 31 which is configured to removably mount into a one piece embodiment of the helmet casing 12 in a registered position, therein thereby providing stable even support the entire face of the patient from forehead to chin. In the one piece version of the helmet casing 12 the front surface would be extended to a point below the chin and thereby accommodate a once piece facial cushion 31 and apply complete support to the head of a patient.

The ocular cushion 26 and chin cushion 28, or one piece facial cushion 31, if reusable, are best made of a closed cell foam material or other cushioning material which does not absorb fluid easily to allow the cushions to be sterilized in the conventional fashion for reuse. In many instances sterilization may not be necessary and a simple washing may provide the required level of cleanliness. In such cases the material used will be durable for reuse and resistant to cleaning to allow multiple uses of the cushions 26, 28, or 31. However, for ease of use and to maintain a highly sterile field about the patient, disposable ocular cushions 26, chin cushions 28, and one piece facial cushions 31 may be more desirable since they could be used once and replaced after each operation to maintain a highly sterile or sufficiently clean field. The best mode as to disposable or reusable is best determined by the criteria of the hospital or surgery center involved and their individual criteria.

Optionally, for an even more custom fit to individual patients is desirable, the ocular cushion 26 and chin cushion 28 or the once piece facial cushion 31 may also be made inflatable with gas or fluid or silicone or other gel such that they may be adjusted in size and flexibility by filling them with a gas or liquid into the cushions through a sealable orifice communicating through the wall of the cushion.

The ocular cushion 26 may be made in a set of multiple ocular cushions 26 varied in dimensions of both thickness and width and have variable sized and located ocular apertures 27 therein to best accommodate the size and facial structure of a variety of differing sized individuals using the same helmet casing 12. The chin cushions 28 may also be from a set of such chin cushions 28 varied in dimensions of both thickness and width to achieve optimum fit on individual patients. The one piece facial cushion 31 used with the one piece embodiment of the helmet casing 12 provides the same adjustable utility and can be varied in the same fashion by providing multiple facial cushions 31 for use as a kit to be combined with one piece helmet casing 12. The facial cushion 31 has a facial indentation 59 formed on a first side of the facial cushion 31 sized to accommodate the face size of the intended patient. The opposite side or exterior surface 38 of the facial cushion 31 would be dimensioned for cooperative engagement with the interior surface 35 of the one piece embodiment of the casing 12. By varying the dimensions of the cushions 26 and 28 or 31, and the size and location of the apertures therein, and matching them to the properly sized one or two piece helmet casing 12, virtually any adult or child may be fitted to wear the resulting assembled device 10 comfortably with optimal support of the facial structure of the cranium and maximal diffusion of pressure and weight about the face and sides of When using a disposable form of cushions 26 and 28, and 31 adhesive or other means for a removable attachment can be placed upon the helmet side of the respective cushion surface for an easy mount of the cushions into the helmet casing 12 and/or repositionable chin support 14. Such a disposable form of cushions 26, 28, and 31, would be kept sterile inside a sealed wrapper in the conventional manner and removed and mounted to the inside face or interior surfaces 35 and 36 of the helmet casing 12 and chin support 14 respectively as necessary in the configuration decided upon, using conventional peel and stick adhesive pads positioned upon the surface of the cushions to attach them to the helmet interior surface 35.

The device 10 offers great utility to the user since it is capable of using either disposable or reusable cushions for cushions 26, 28, or 31, or combinations thereof at the discretion of the professional using the device. Where disposable cushions are desirable due to their ease of use and lack of the need for sterilization, just the helmet casing 12 and chin support 14, if used, need be sterilized. Or, in the case of the once piece casing just the casing need be sterilized if required. However, a reusable form of cushions 26, 28 and 31 may also be used in the device 10 where the cushions can be sterilized between use, or, in instances where sterilization is determined not to be needed they need only be washed. Or, a combination of reusable and disposable cushions 26, 28 and 31 may be used should such be desired or required if a reusable cushion is lost or damaged.

In use, with the two-piece embodiment, the patient would be measured for the optimum helmet casing 12 size which would be chosen from a plurality of available interchangeable helmet casings available, and, a chin support 14 of proper size which would be chosen from a plurality of interchangeable chin supports capable of attachment to said casing 12. Also chosen to accommodate differing facial and head dimensions would be the properly dimensioned cushions 26 and 28, from a set of interchangeable cushions, to allow the patient maximum comfort and diffusion of pressure about the surface of the face and side of the head. The patient could be given samples of the different sizes of cushions 26 and 28 from a set of variable dimensioned cushions 26 and 28 to which the patient would give input as to the best possible fit or a medical technician might also help determine the optimum casing and cushion dimensions with or without the patient's input. This availability of an assortment of cushions and assembled helmet sizes allows for a modular system of helmet casings 12 and attachable chin supports 14 assembled to the helmet, to be used in conjunction with the desired dimension of cushions 26 and 28, also from a set of such cushions of differing dimensions, to achieve the optimum fit on a variety of sizes of patient heads.

Once the optimum dimensions of the cushions 26 and 28 are determined, yielding a comfortable fit and maximal pressure distribution about the face and sides of the head, the cushions 26 and 28 are removably mounted into the interior of both the helmet casing 12 and chin support 14 using the aforementioned adhesive or fastener cooperating mounts 32 located upon the cushions which attach to cooperating mounts 33 which are positioned upon the helmet casing 12 and chin support 14 respectively. This is accomplished in a manner to allow for the mounting the cushions 26 and 28 into the cooperatively configured interior surfaces 35 and 36 of the helmet casing 12 and chin support 14 respectively.

The inside surface 35 of the helmet casing 12 features a casing ocular aperture 37 and the chin support 14 has a chin support aperture 39. When properly positioned in the cooperating inside faces of the helmet casing 12, the aperture 27 in the ocular cushion 26 will be relatively in line with the casing ocular aperture 37 such that the eyes and nose and some surrounding portions of the patient's face, or the ocular area of a patient's face, may be easily viewed through the ocular aperture 37 when the device 10 is being used during surgery after being positioned upon the patient's face. The ocular aperture 27 might best be made slightly larger than the casing ocular aperture 37 to allow for easy mounting of the ocular cushion 26 into the helmet casing 12 to allow for the patient's eyes and surrounding skin area to be viewed through the casing ocular aperture 37 and relatively in-line cushion ocular aperture 27. Where the casing ocular aperture 37 wraps around to the side of the helmet casing 12, the in-line ocular cushion aperture 27 would also wrap around in a relatively in-line position with the casing ocular aperture 37. This in line relationship of apertures creates a viewing passage communicating through the helmet casing 12 and apertures 37 and 27 thus revealing the patient's temple area of the head in addition to the ocular area of the face and the nose. This in line relationship of the apertures of the cushions 26 and 28 with the casing apertures 37 and 29 also allow for the passage of conventionally used tubes through the in line apertures into the patient's nose and/or mouth for providing life support during the operation. Further, the cavity formed by the in line cushions 26 and 28 attached to the helmet casing 12 and chin support 14 gives protection to these tubes at the critical entry and exit positions on the patient at the nose and mouth such that the tubes, inside the cavity, will not bend to a point where flow therethrough is interrupted with possible life threatening consequences to the patient. For additional utility, optional tube passages 44 communicating a tubular passageway from the interior of the device 10 to the exterior, can provide for communication of tubes or sensing device wires therethrough to the patient. Exterior mounted optional tube positioners 46, of hook and loop fabric or other type of fastener suited to the job, can be optionally mounted upon the exterior of the device 10 to hold tubing and/or wires for monitoring the patient operatively therein during surgery. Snap on fasteners may also be optionally attached at the exterior of the device 10 to hold tubing and the like. By providing optional strategically placed snap mounts 48 the snap on fasteners may be placed in differing positions about the exterior to hold the tubing and/or wiring required for certain surgical procedures in place and out of harms way.

The chin support aperture 39 of the two-piece embodiment lines up with the bottom of the casing ocular aperture 37 when the dismountable chin support 14 is operably mounted to the helmet casing 12. The chin support aperture 39 allows for viewing and access to the lower mouth area of the face of the patient with the chin of the patient being supported by the chin aperture 39 in chin cushion 28 removably attached to the interior surface 36 of the chin support 14.

Added utility is provided by the device 10 operably mounted to the face of the patient using attributes of the frontal surface 41 of the device 10. This frontal surface 41 if made flat like that of the upper table surface 64 of a conventional operating table, allows for a stable support of the patients face inside the properly mounted device 10 when the frontal surface 41 is placed upon the operating table without a mount if such a positioning is desired. For especially stable maintenance of the patient's head when in a sideways position a second side flat surface area on the sidewall 47 area may be located on one or both sidewalls 47 of the device 10.

Figure 7:
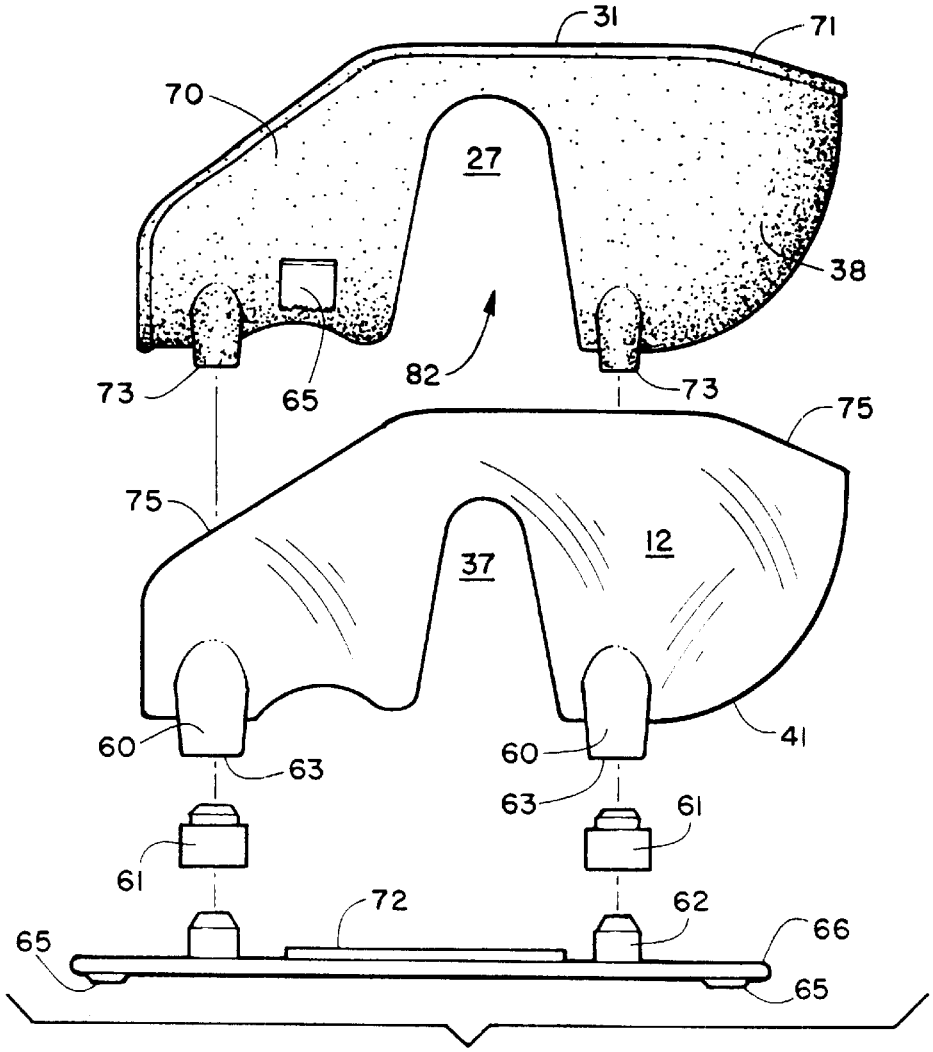
FIG. 7 depicts another embodiment of the device featuring an exploded view a helmet casing of unitary construction with insertable modular pad providing facial and chin support in a single combined unit.

Or, as depicted as the one-piece embodiment of the device in FIG. 7, legs 60 attached to the casing exterior surface 49 can provide both a means for elevation of the helmet casing 12 above the couplings 62 on the mounting plate 66 and underlying table surface 64 and if desired, registration using at least two of the couplings 62. The couplings 62 as depicted, are dimensioned to cooperatively engage the distal ends of the legs 60 and can be mounted directly to the operating table surface 64 using a means for attachment to the operating table surface 64 such as adhesive 65, frictional engagement, or other means of attachment to the table surface 64. Or in the current best mode a mounting plate 66 would have the couplings 62 mounted thereon positioned to provide a registerable mount through cooperative engagement with an axial leg aperture 63 in the distal end of the legs 60. Insertable leg extensions 61, made of differing lengths to achieve the desired elevation, provide an adjustable means for elevation would fit between the leg apertures 63 and onto the couplings 62 providing a means for height adjustment of the helmet casing 12 above the underlying table surface 64 to accommodate various posture positions for the patient's head and neck.

The single piece embodiment of the helmet casing 12 features a front wall surface 41 which extends laterally and then curves to a pair of side walls 47 both of which begin at one side with their communication with the front wall surface 41 and extend vertically at an acute angle from the front wall surface 41 to form the two substantially parallel sidewalls 47. In this embodiment the casing ocular aperture 37 in the current best mode, is enlarged and extended around and through the front wall surface 41 and upward onto and through at least one side surface 47 of the helmet casing 12 providing a clear view of the patients eye, and face in the temple area, as well as the area in front of the nose, from one or both sides of the device 10. Extending the casing ocular aperture 37 and the cushion ocular aperture 27 up at least one sidewall 47, whether they are used in combination or when the cushion might be used by itself, thus provides a means to view the eye socket and surrounding area through the sidewalls 47 of the device of the patients who might use the device. In the current best mode, the ocular apertures of both the once piece helmet casing 12 and the facial cushion 31 extend up both sidewalls 47 to provide a viewing passage 82 of both eyes and the surrounding temple area of the head of the patient through the sidewalls 47. Viewing of the temple area is also achieved through the transparent material making up the helmet casing 12 and would allow for a larger ocular cushion aperture 27 to provide more of a view of this area thus allowing even greater viewing of the patients eye area much like a window.

During times of moving of the patient for roll over or off of the surgical table and onto a gurney, an optional top handle 40 attached to the top area of the helmet casing 12 portion of the assembled device 10 allows medical personnel a solid griping point for providing head and neck support to the patient while being rolled over or otherwise moved. By holding the patient's neck with one hand and the handle 40 in the other, essential support can be provided to avoid injury to the anesthetized patient. A roller or ball or other conventional bearing 42 can also be placed at the base of the handle 40 should easy rotation of the handle 40 be desired during use. Such a rotation of the handle 40 on the bearing 42 allows for a smooth roll over of the patient with the patient's neck concurrently supported, thus minimizing possible neck injuries during roll over and other hazardous patient relocation procedures.

Additional utility in the disclosed apparatus herein is provided by the insulating factor provided to the patient wearing the surgical helmet 10 and cushions 26, 28, and 31, when mounted upon the face of the patient during a surgical procedure. Operating rooms are conventionally kept quite cold to keep medical personnel and surgeons cool and alert during surgical procedures. The patient however is generally unclothed during such procedures and can suffer discomfort from the overly cool environment of the room. The cushions 26, 28 and 31, form to the face of the patient and are mounted upon the interior surface 35 of the device 10, and thereby encompass the face and part of the sides and top of the head of the patient. The result being that the face, sides, and top of the patient's head are insulated from the cool room temperature, helping to keep the patient warmer in the unnaturally cool environment of the operating room.

Further utility is also provided by this surgical helmet device 10 through the use of optional slot passages 45 located in the face of the device for positioning of tubes therein. During a surgery requiring the patient to lay face down, tubes providing breathing supplies to the patient may be positioned in a slot configured to allow the tube to recess therein such that the tube will not collapse when the patient is face down and the tube is between the table and casing exterior surface 49 of the device 10. Such a slot passage or multiple slot passages 45 may be positioned about the face of the helmet in other locations than shown.

FIG. 7 depicts a preferred embodiment of the device 10 featuring an exploded view showing the helmet casing 12 of a one piece or unitary construction. In this embodiment, the casing walls are best constructed of rigid substantially transparent material such as plastic in a unitary construction. This embodiment provides the same desired support for the chin and face provided by the two-piece embodiment accomplishing this support with a cooperatively engageable once piece facial cushion 31. This one piece embodiment continues to provide proper chin and face support by slightly elongating the helmet casing 12 in a one piece design and combining the ocular cushion 26 and chin cushion 28 into a one piece facial cushion 31 which is dimensioned on the exterior surface 70 of the facial cushion 31 for cooperative engagement with the interior surface 35 of the helmet casing 12. The facial cushion 31 is dimensioned on the interior surface 69 to provide a comfortable fit to the face of the patient for which it is to be used. In use, in essentially the same manner as the two-piece embodiment, the intended patient would be measured for the optimum facial cushion size 31 which would be chosen from a plurality of available interchangeable facial cushions 31 available for registered cooperative engagement with the one piece helmet casing 12.

In many cases only one or two different sized helmet casings 12 would be needed in inventory to be mated with cushions to accommodate a very large number of differently dimensioned facial cushions 31 since the size, thickness, and exterior and interior dimensions of the facial cushion 31 may be varied to accommodate the different facial dimensions of different patients. This is accomplished by the variance of the dimensions of the indentations 68 formed on the interior surface 69 of the facial cushion 31 which are used accommodate the facial dimensions of the intended patient. The exterior surface 70 of the facial cushion 31 would be dimensioned for operative cooperative engagement with the shape and dimensions of the interior surface 35 of the helmet casing 12 in the aforementioned registered and cooperative engagement therein.

The registration and cooperative operative engagement between the cushion 31 and helmet casing 12 would be maintained using a means for registered engagement of the facial cushion 31 with the helmet casing 12 which includes one, or a combination, of registration means, from a group of such registration means consisting of frictional engagement between the interior surface 35 of the helmet casing 12 and exterior surface 70 of the facial cushion 31, adhesive 65, a lip 71 located about the upper exterior surface 70 of the facial cushion 31 in a position to cooperatively engage the upper edge 75 of the sidewalls 47 of the helmet casing 12, or, registration pins 73 attached to the body of the facial cushion 31 in positions to cooperatively engage registration apertures in the casing, in this case axial passages 77 formed into the legs 60 and sized to accept the registration pins 73 in a removable cooperative engagement. Since the registration pins 73 would in the current best mode be molded of the same flexible foam as the facial cushion 31 they offer the current best mode of registration since the registration pins 73 will compress during insertion into the axial passages 77 and then naturally bias against such compression into removable biased frictional engagement with the interior of the axial passages 77. While the aforementioned are the current best mode of a registration means between the facial cushion 31 and the helmet casing 12, those skilled in the art may devise other such means of registered engagement and such are anticipated.

In fitting the patient for maximum comfort and support, the patient could be given samples of the differently dimensioned facial cushions 31 from an available plurality or set of variably dimensioned facial cushions 31 to which the patient would give input as to which formed indentations 68 provide the best possible fit to the facial dimension of the patient. Or, a medical technician might also help determine the optimum helmet casing 12 and facial cushion 31 dimensions with or without the patient's input. This availability of an assortment of differently dimensioned facial cushions 31 to cooperatively and operatively engage one or a plurality of helmet casings 12, allows for a kit or modular system of helmet casings 12 and attachable to facial cushions 31 to achieve the optimum fit on a variety of sizes of patient heads. For easy identification of size the facial cushions 31 would be marked with appropriate indicia 30 in writing showing a size designation or in the best current mode with indica in the form of color coding for easy identification. The color coding or written indica 30 to identify size could be imparted by extruding it in the color of the foam making up the facial cushion 31 or silkscreened or otherwise applied on the surface of the cushions 26, 28, and 31. Once the optimum dimensions of the facial cushion 31 are determined, yielding a comfortable fit and maximal pressure distribution about the face and sides of the patient's head, the facial cushion 31 is removably mounted to the interior of the helmet casing 12 using the aforementioned means for registered engagement of the facial cushion 31 with the helmet casing 12.

The one piece facial cushion 31 offers an additional benefit in that in some cases it might be used without the helmet casing 12. Use without the casing might occur when an especially low mount of the patient's head is desired for posture or for the surgical procedure, or, in an emergency or other situation where the additional support and utility of the in-line helmet casing 12 is not required. Use of the facial cushion 31 by itself, while not offering the full utility of the best mode in combination with the helmet casing 12, does provide the easy side viewing of the patients eyes through the elongated ocular cushion aperture 27 and still provides improved support and padding to the patient's head during surgery. Consequently, it is anticipated that the cushion might be used alone without the casing 12, and while not providing all of the utility of the device featuring the combination of the facial cushion 31 with the helmet casing 12, using the cushion alone would still provide much better support to the patient's face, a clear view of the eyes through the elongated cushion ocular aperture 27 and a solid support to the patient's head on the table through frictional engagement therewith.

Or, in some cases, where reuse of the cushion may not be advisable due to the patient, the helmet casing 12 might also be formed into the exterior of the facial cushion 31 itself. This could be done if a substantially rigid shell 80 were formed about the exterior surface 70 of the facial cushion 31 by either lamination thereto or in the molding process and would provide rigid support to the facial cushion 31. However this configuration with the helmet casing 12 as attached to the facial cushion 31 as a laminated or permanent shell yields less utility in that different facial cushions 31 for different sized patients could not be matched to a single helmet casing 12 thus requiring more stock of product. But, differing user criteria and requirements may call for the facial cushion 31 to be thus used and manufactured with a casing formed by the rigid shell 80 formed on the outside surface for use without the additional advantages afforded by mating with the helmet casing 12 and such is anticipated. While the current best mode of the device, affording the most utility, is the registered engagement of a properly sized facial cushion 31 with the helmet casing 12, the cushion-only embodiments offer the operating staff the option to use the facial cushion 31 without the helmet casing 12 and still achieve much better support of the patient's head, thermal insulation and view of the patient's eye and surrounding temple area 74 which is a marked improvement to the current practice of placing the head on a towel. The very nature of the exterior surface 70 of the soft foam facial cushion 31 would provide a good frictional mount to the surface of the table surface 64 and good side and frontal support to the head of the patient with a concurrent view through the elongated casing ocular aperture 37 reaching around the side to allow a view of the patient's eye socket from an operative distance. Use of the facial cushion 31 could also occur if there were a shortage of helmet casings 12 for the number of patients requiring surgery during an emergency situation. Consequently it is anticipated that the facial cushion 31 could be used by itself in certain instances and would still be a substantial improvement for a mount and support of the patient's head than the present art.

To provide an excellent view of the patient's facial features, as with the two piece embodiment, the interior surface 35 of helmet casing 12 features a casing ocular aperture 37 communicating through the casing front wall 41 surface and side walls 47 and the chin support aperture 39 formed into the front wall 41 surface and communicating therethrough. The one piece embodiment the helmet casing 12 as noted also features an elongated casing ocular aperture 37 which wraps around the helmet casing 12 to determined termination points in one or both substantially parallel side walls 47, and thus allow for easy viewing of the eye area of the patient during use by looking through the in line casing ocular aperture 37 and cushion ocular aperture 27. In the one piece embodiment this casing ocular aperture 37 communicates with the chin support aperture 29 to yield a somewhat figure eight shaped aperture when the casing is viewed from the bottom. The in line ocular cushion ocular aperture 27 where it intersects the cushion chin support aperture 39, yield a nose cavity 57 the area of which is defined by the thickness of the wall surface of the facial cushion 31 and the perimeter of the intersecting chin support aperture 39 and the cushion ocular aperture 27. Along with providing a passageway for tubes to the patient, the nose cavity 57 also yields a good view of the nose and facial area around the nose when the patent is in the prone position, providing additional utility to the device.

When properly positioned, the cooperating engagement of the facial cushion 31 and helmet casing 12, will place the cushion ocular aperture 27 substantially in line in a registered position in relation to the casing ocular aperture 37. The ocular cushion ocular aperture 27 might best be made slightly larger than the helmet casing ocular aperture 37. This slight increase in size provides for easy mounting of the facial cushion 31 into the helmet casing 12 to a position to allow the patient's eyes and surrounding skin area to be viewed through the wrap around casing ocular aperture 37 and relatively in-line cushion ocular aperture 27. When the helmet casing 12 is substantially transparent material, as in the current best mode, the increased size of the apertures of the facial cushion 31 also increase the area around the eyes and nose of the patient that can easily be viewed since these areas may be viewed through the helmet casing 12 itself.

As noted, in the current best mode, the casing ocular aperture 37 wraps around from the front to both sides of the helmet casing 12. The ocular cushion aperture 27 would also wrap around substantially the same such that when mounted it would engage the casing ocular aperture 37 in a relatively in-line position, registered with the ocular casing aperture 37. A viewing passage 82 provides a means to view the eyes and nose and some surrounding portions of the patient's face through the sidewall 47 is thus defined and provided by the in-line relationship of the wrap around facial cushion ocular aperture 27 and the casing ocular aperture 37 and the cushion chin support aperture 39 and the casing chin aperture 29 thus forming the viewing passage communicating through the helmet casing 12 and the apertures in the facial cushion 31 providing an excellent view of the patient's temple area of the head in addition to the ocular area of the face and a nose cavity 57 for accommodating and viewing the nose from both sides of the device and well as from below the device when mounted on the operating table. This in-line relationship of the cushion apertures 27 and 39 with the casing apertures 37 and 29 also allows for the passage of conventionally used tubes through the in line apertures into the patient's nose and/or mouth for providing life support during the operation.

Figure 8:
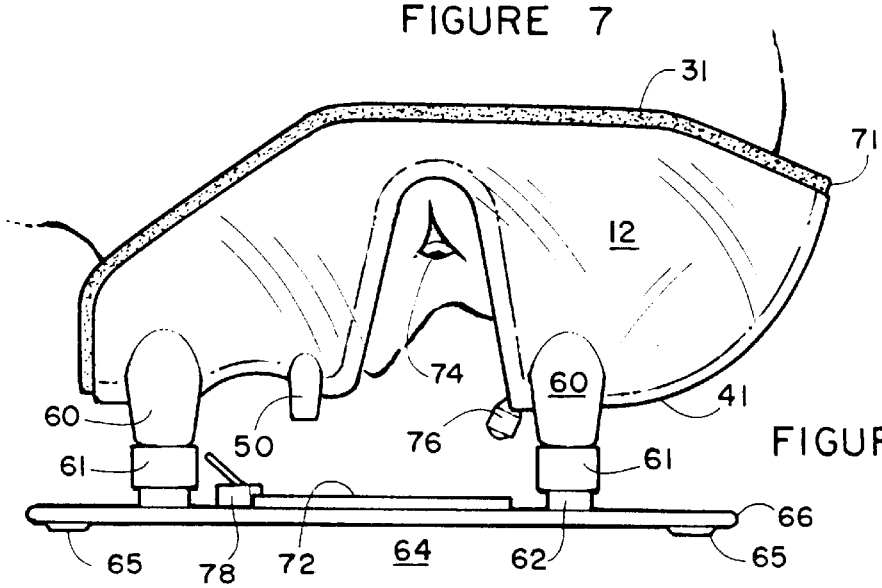
FIG. 8 depicts the helmet casing of FIG. 7 in a registered position removably or otherwise attached to a mount with optionally mirrored surface for reflection of the patient's face therein.

FIG. 8 depicts the facial cushion 31 inserted and registered in position with the helmet casing 12 which is in a registered position removably attached to an optional mount plate 66 using couplings 62 configured to cooperatively engage the distal ends of the legs 60 which are attached to the helmet casing 12 at their opposite ends. The couplings 62 are depicted as pins that insert into indents in the legs 60 but this arrangement could be reversed with the legs positionable into indents in the mounting plate 66 or other means for attachment of the legs 60 to the couplings 62 could be used and are anticipated. If needed to adjust the height of the helmet casing 12, and thus the height of the head of the patient for comfort or function, one or a plurality of leg extensions 61 may be used to adjust the height as desired. The leg extensions 61 would of course be configured to operatively engage in a fit between the legs 60 and the couplings 62.

The couplings 62 alone using adhesive or other manner of attachment could be pre-installed to the operating table surface 64 in cases where the optional mounting plate 66 is not desired, however in the current best mode, the mounting plate 66 positioned on the operating table surface 64 would provide the couplings 62 attached in positions to cooperatively engage the distal end of the legs 60 to thereby provide a stable means of elevated attachment of the helmet casing 12 above the table surface 64 in registered engagement with the mounting plate 66.

By the provision of a means for elevation, through the provision of legs 60 to slightly elevate the helmet casing 12 above the operating table surface 64, and the means for elevation adjustment using the leg extensions 61, or other manner of extending the length of the legs 60 such as telescopic legs, or legs extending with pins to hold the elongation of the legs, better patient posture is achieved by keeping the patient's neck in line. Elevating the helmet casing 12 and patient therein also elevates the casing ocular aperture 37 and casing chin aperture 29 thereby allowing better views therethrough of the patient for direct viewing by the staff. The casing ocular aperture 37 being extended around the frontal area and communicating between the casing interior surface 35 and casing exterior surface 49 and extending to the side area of the helmet casing 12, provides an easy and clear view of the patients eye and temple area 74. For additional utility, the aforementioned optional tube passages 44 could be operatively positioned in the once piece embodiment of the helmet casing 12 to provide a tubular passageway from the interior of the device 10 to the exterior for the various devices requiring such.

While elevating the helmet casing 12 provides extra room between the table and the in-line apertures to allow better viewing of the patient from the side and below, in the current best mode, the placement of a mirrored surface 72 on the upper surface 67 of the mounting plate 66 provides additional utility through the provision of a means for the upright operating staff to view of the patients eyes and temple area around the eye, through the in line ocular and chin apertures 29 and 37. Normally the doctor or staff member wishing to view the patient's eyes area adjacent to the eye temple area 74 or face would have to stoop to an angle wherein they can be seen through the in line apertures in the helmet casing 12 from the side, or in some cases from below the operating table. However, with the provision of a mirrored surface 72, operatively placed on the upper surface 67 of the mounting plate 66, the doctors and staff are afforded a means for a continuous real time view while standing, of the patient's eyes and mouth through the apertures 37 and 29 in the helmet casing 12. Should even more adjustability of the reflection be desired so that certain staff in certain positions can see the patient's eyes and mouth, a means for angular adjustment of the mirrored surface 72 could be attached between the mounting plate 66 and the mirrored surface 72 such as a ratchet 78 or other conventional means for angular adjustment that will provide the user with the ability to adjust the angle of the mirrored surface 72 from substantially parallel to the mounting plate 66 toward a position normal to the mounting plate 66. The mirrored surface 72 with the means for angular adjustment thus may be positioned to an infinite number of angles between positions parallel and normal to the mounting plate 66. Such adjustment provides substantial utility to the operating room staff and doctors by allowing them to adjust the mirrored surface 72 to obtain the best possible view of the patient through the in line apertures of the facial cushion 31 and helmet casing 12.

Should additional enhancement of patient viewing be desired, the addition of the optional illumination means in the current best mode in the form of light 76 which further enhances the reflected view in the mirrored surface 72 by illumination of the patient's facial features which reflect in the mirrored surface 72. The illumination means could be a conventional light bulb, a light emitting diode, or other similar light sources and can be powered by conventional AC or battery power that is readily available in the operating arena.

Figure 9:
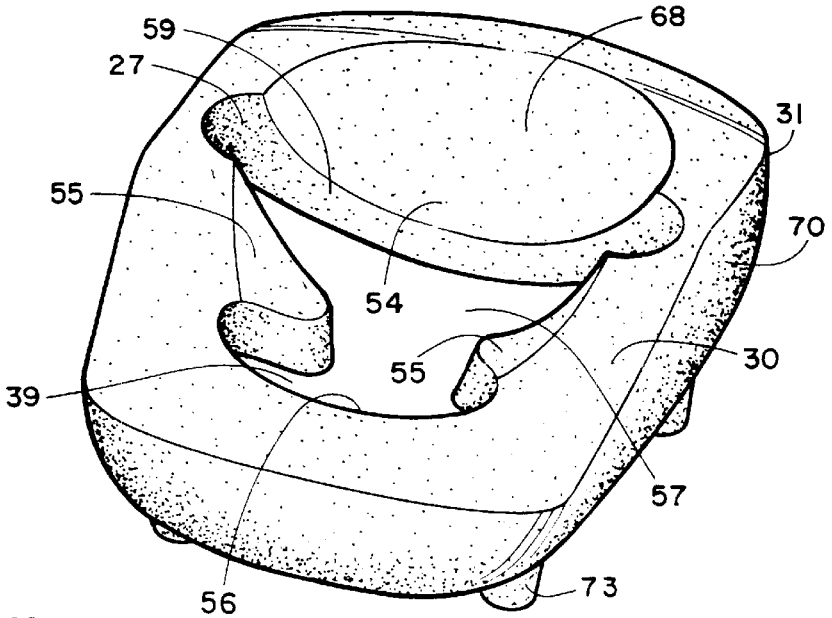
FIG. 9 is a top perspective view of the facial cushion showing the facial indentation and apertures therethrough.
Figure 10:
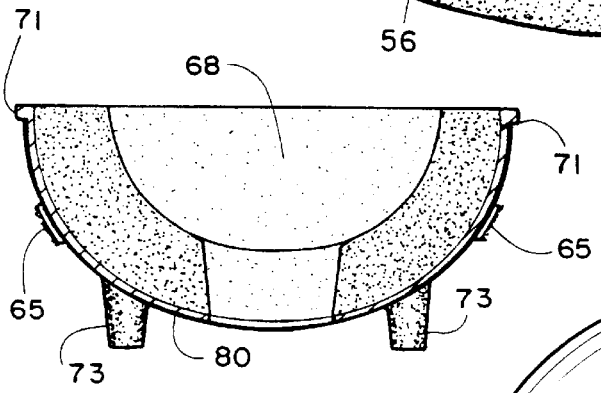
FIG. 10 depicts and end cut away view of the facial cushion for removable mounting to the helmet casing showing the facial indentation formed to accommodate patient facial structures therein, and the lip for registration with the casing edge.

Construction of the one piece embodiment of the facial cushion 31 and the various options thereto, is best depicted in FIG. 9 and FIG. 10. As shown from the top perspective view of FIG. 9, the indentations 68 to accommodate various sized faces and facial structures are operatively positioned and provide excellent head support in the form of a forehead support 54, cheek supports 55 and chin support 56. The registration pins 73 protrude from the exterior surface 70 in positions to register the facial cushion 31 in operative engagement with the leg axial passages 77 extending axially through the legs 60 of the one piece embodiment of the helmet casing 12. Registered insertion of the facial cushion 31 into the helmet casing 12 is thus easily achieved by the in line cooperative engagement of the registration pins 73 with the axial passages 77 in the legs 60. Of course the other aforementioned means of registration of the facial cushion 31 with the helmet casing 12 might also be used including the lip 71, adhesive 65, or frictional engagement of the exterior surface 70 of the facial cushion 31 with the interior surface of the helmet casing 12. In cases where the additional utility of the helmet casing 12 encompassing the facial cushion 31 is not required the facial cushion 31 could be used alone in a frictional engagement with the surface of the table surface 64.

Figure 11:
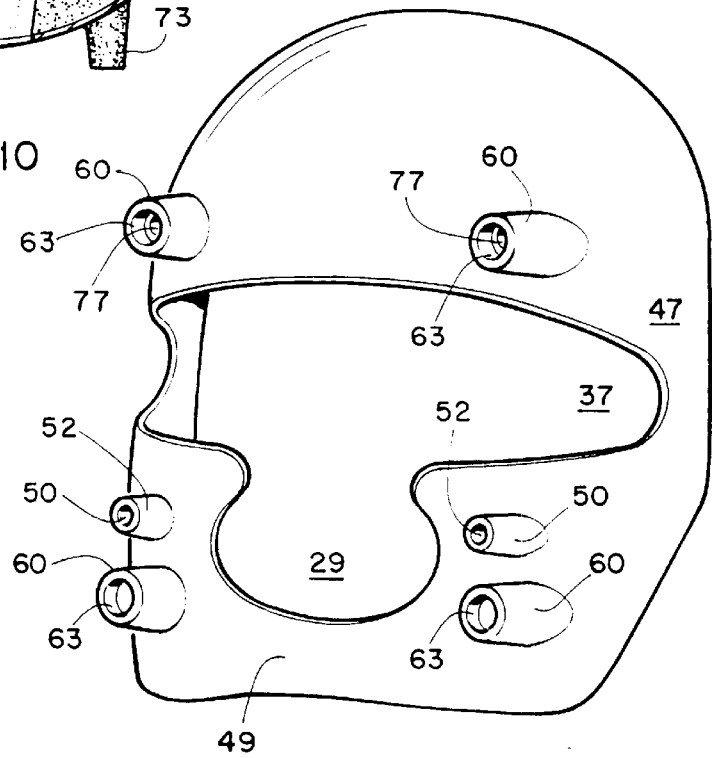
FIG. 11 depicts a bottom perspective view of the helmet casing showing the unitary construction and the legs affixed to the exterior which provide an elevated mount along with the communicating aperture through the casing.
Figure 12:
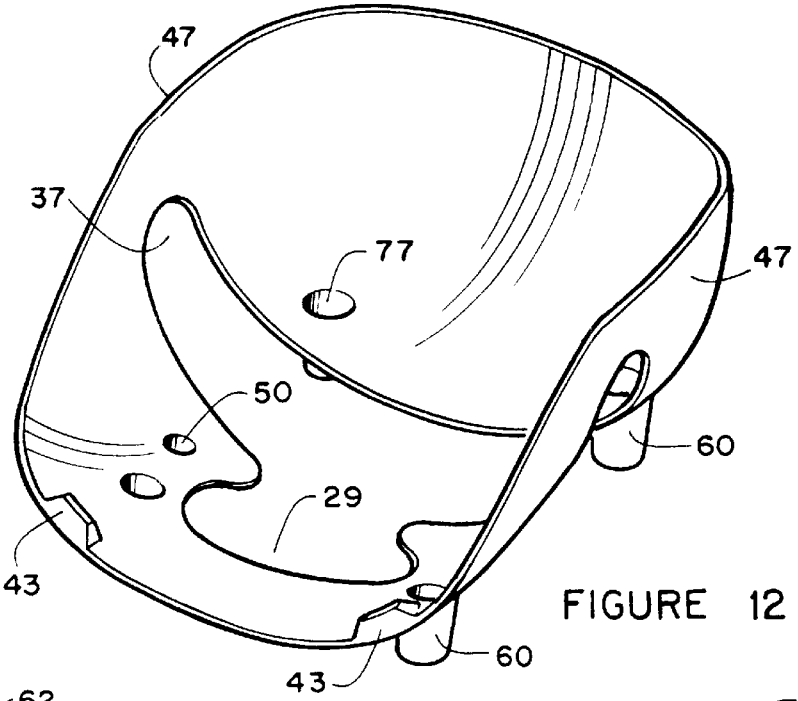
FIG. 12 depicts a top view of the mounting base for the helmet casing with a surface mounted mirror and light source.

FIGS. 11 and 12 provides a bottom perspective view and a top perspective view respectively, of the one piece embodiment of the helmet casing 12. As shown, the legs 60 contain the axial passageway 77 therein communicating with an leg aperture 63 at each end for registered engagement of the molded registration pins 73. The elongated casing ocular aperture 37 in the one piece casing extends across the bottom and up both sides of the one piece helmet casing 12, and communicates with the chin aperture 29 to form a single large "t" or figure eight shaped aperture which registers in an in-line relationship with a similar shaped and slightly larger aperture in the one piece facial cushion 31. Also depicted are a pair of optional tube passageways 50 providing communication to the interior of the helmet casing 12 through axial tube passages 52 therein.

Figure 14:
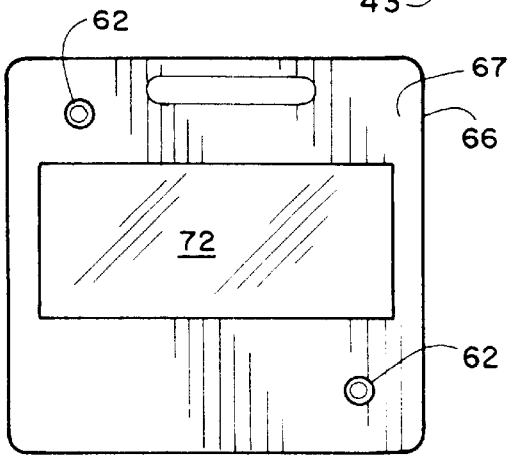
FIG. 14 is a top view of the upper surface of the mounting plate showing the mirror and mounts.
Figure 13:
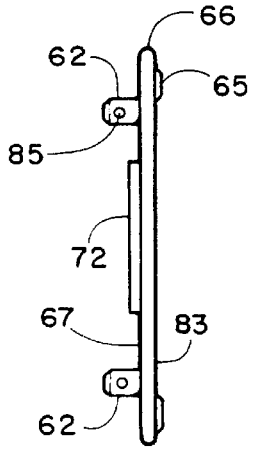
FIG. 13 depicts a side view of the mounting plate with a mirror and cooperatively engageable mounts on the upper surface.

A preferred embodiment of the mounting plate 66 component is depicted in FIGS. 13 and 14. The mounting plate 66 in the current best embodiment is constructed of rigid plastic such as polycarbonate which is substantially transparent. A plurality of couplings 62 are attached to the upper surface 67 of the mounting plate 66 to provide the registered mount for the legs 60 of the helmet casing 12. In this embodiment, rather than having the mirrored surface 72 on the upper surface 67 of the mounting plate 66 the mirrored surface 72 is adhered to the bottom surface 83 of the mounting plate 66. Adhering the mirrored surface 72 to the mounting plate bottom surface 83 facing upward toward the tope surface, allows the mirrored surface 72 to provide the desired reflection of the patients face through the substantially transparent plastic material of the mounting plate 66 while concurrently protecting the mirrored surface 72 from scratching. In this embodiment the mirrored surface 72 may be adhered to the bottom of the mounting plate 66 by using mirror attached into an indent in the bottom surface 83 or by applique of a metalized or reflective surface to the bottom surface 83 such that when viewed through the substantially transparent material making up the mounting plate 66 from the upper surface 67 a reflection is provided. The depicted optional outwardly biased conventional plunger ball 85 would provide additional stability to the couplings 62 in their cooperating engagement with the legs 60.

Figure 15:
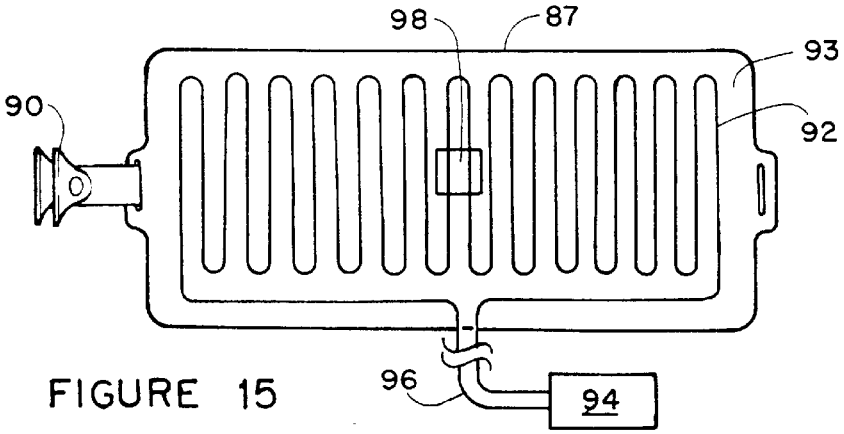
FIG. 15 is a tope view of the removably attachable heating blanket with temperature control and clip.

Additional utility during procedures where the temperature of the patient is a concern is provided by the optional removably attachable means for heating the head of the patient. In the current best embodiment the means for heating the head of the patient is provided by a removably attachable heating blanket 87 as depicted in FIG. 15. The heating blanket is removably attachable to the helmet casing 12 using biased clip 90 which is spring loaded and attaches to an upper edge of the helmet casing 12. The heating blanket 87 provides heat using a resistive element 92 which heats the blanket body 93 when power from an electrical power source 94 is communicated thereto through conventional wires 96. The heat is distributed evenly by the serpentine arrangement of the resistive element 92 thus avoiding hot spots. Control of the amount and duration of heat would be provided by a conventional thermostat 98 engagement with the resistive element 92 to break the circuit when the desired temperature is obtained. The wires 96 might also be a flat strip style wire that is appliqued to the exterior surface 70 of the helmet casing 12 and an interface on the clip 90 such that attaching the clip 90 to the helmet casing 12 would also provide power to the blanket 87 through the interface in the clip 90. Alternatively, in some cases it may be more advantageous to attach the resistive element 92 by affixing it or appliqueing it to the interior surface of the helmet casing 12 in between the facial cushion 31 and the helmet casing 12 where it would work in the aforementioned fashion but provide heat to the face of a prone patient or the back of the head of a supine patent using the disclosed device.

While all of the fundamental characteristics and features of the protective cushion and cooperatively engageable helmet casing for anesthetized patient have been shown and described, it should be understood that various substitutions, modifications, and variations may be made by those skilled in the art without departing from the spirit or scope of the invention. Consequently, all such modifications and variations are included within the scope of the invention as defined by the following claims.

What is claimed is:

1. A protective helmet apparatus for providing patient cranial support during surgery, which may be assembled from a plurality of cooperatively engageable components of differing dimensions for achieving optimum fit and pressure diffusion upon face of the intended helmet wearer comprising:

a cushion, said cushion having a front portion and two cushion sidewalls extending upward from said front portion, said cushion having an interior surface and an exterior surface;

said interior surface of said cushion dimensioned to accommodate the facial structure of a human being;

at least one cushion ocular aperture in said cushion communicating laterally across said front portion and continuing up both of said two cushion sidewalls, said ocular aperture providing communication between said interior surface and said exterior surface;

a viewing passage formed by said cushion ocular aperture, said viewing passage providing a view through said cushion sidewalls, wherein one of the two eyes of a patient wearing said cushion while in the prone position, may be seen though said viewing passage from a position adjacent to either of said two cushion sidewalls, thereby allowing both of said patients eyes to be viewed through said viewing passage.

2. The device as in claim 1 wherein said exterior surface of said cushion is dimensioned for cooperative registered engagement with the interior of a helmet casing wherein said cushion is interchangeably positionable to either one of a first position cooperatively engaged with a helmet casing or a second position with said exterior surface of said cushion supported on a mounting surface, whereby said cushion may be used either in said first position or said second position to provide support to the head of a patient undergoing surgery.

3. The protective helmet apparatus as defined in claim 2 further comprising:

a helmet casing for use in combination with said cushion, said helmet casing having a casing front wall and two casing sidewalls, each of said casing sidewalls attached at a first edge to said casing front wall and extending generally vertically therefrom to an upper edge of said sidewalls, said helmet casing having a casing interior surface and a casing exterior surface;

means for registered cooperative engagement of said cushion with said helmet casing;

at least one casing ocular aperture in said helmet casing communicating between said casing interior surface and said casing exterior surface, said casing ocular aperture shaped substantially similar to said cushion ocular aperture, and positioned in said helmet casing to substantially align with said cushion ocular aperture when said cushion is in said registered cooperative engagement with said helmet casing, whereby either of said eyes of a patient wearing said cushion may be seen through the respective adjacent casing sidewall of said helmet casing when said cushion is in registered cooperative engagement with said helmet casing; and means for removable attachment of said helmet casing to said mounting surface.

4. The protective helmet apparatus as defined in claim 3 wherein said means for registered cooperative engagement of said cushion with said helmet casing comprises one or a combination of means for registered cooperative engagement from a group consisting of, said casing interior surface dimensioned for frictional engagement with said exterior surface of said cushion, adhesive, a lip positioned on said cushion in a position for operative engagement with the upper edges of said casing sidewalls, and registration pins affixed to said exterior surface of said cushion cooperatively engageable with registration apertures located in said interior surface of said helmet casing.

5. The protective helmet apparatus as defined in claim 4 wherein said means for registered cooperative engagement of said cushion with said helmet casing is a plurality of said registration pins extending from the exterior surface of said cushion, said registration pins dimensioned to cooperatively engage axial passages communicating through said casing.

6. The protective helmet apparatus as defined in claim 3 wherein said means for removable attachment of said helmet casing to said mounting surface comprises a plurality of legs extending from the exterior surface of said helmet casing, the distal ends of said plurality of legs configured for cooperative engagement with a mount, said mount attachable to said mounting surface.

7. The protective helmet apparatus as defined in claim 3 further comprising:

a chin aperture communicating through said front portion of said cushion, said chin aperture communicating between said interior surface and said exterior surface of said cushion, and a nasal cavity defined by the perimeter of said chin aperture and the wall surface of said chin aperture.

8. The protective helmet apparatus as defined in claim 7 further comprising a casing chin aperture in said casing front wall said casing chin aperture communicating between said casing interior surface and said casing exterior surface, said casing chin aperture shaped substantially similar in shape to said cushion chin aperture and positioned to substantially align with said cushion chin aperture when said cushion is in said registered engagement with said helmet casing; and said nasal cavity communicating from said interior surface of said cushion to said exterior surface of said casing thereby forming a tube passageway.

9. The protective helmet apparatus as defined in claim 8 wherein said cushion chin aperture and said cushion ocular aperture communicate to form a single cushion aperture communicating through said cushion, said casing chin aperture and said casing ocular aperture communicating to from a single casing aperture substantially the same in shape as said single cushion aperture; and said single cushion aperture and said single casing aperture are substantially in line when said cushion placed in said cooperative engagement with said helmet casing.

10. The protective helmet apparatus as defined in claim 3 further comprising a means for elevation of said helmet casing above said mounting surface.

11. The protective helmet apparatus as defined in claim 6 wherein said mount comprises a mounting plate, said mounting plate having an upper surface and a lower surface;

means of attachment of said lower surface to a determined position on said mounting surface; and a plurality of couplings affixed to said upper surface of said mounting plate in positions to register with said distal ends of said plurality of legs, said couplings dimensioned for cooperative engagement with the distal end of said legs, whereby said legs may be removably mounted to said couplings in a cooperative registered engagement therewith.

12. The protective helmet apparatus as defined in claim 3 wherein said cushions are in a kit of variably sized cushions to accommodate a variety of head sizes each of said cushions in said kit configured for cooperative registered engagement with said helmet casing whereby said combination of said helmet casing and said cushion may be fitted to a variety of different sized patients having different physical characteristics and may be assembled from said collection of interchangeable cushions.

13. The protective helmet apparatus as defined in claim 10 wherein said means for elevation of said helmet casing above said mounting surface comprises a plurality leg extensions chosen from a kit of said leg extensions of varying length, each of said leg extensions configured for cooperative engagement between the distal end of said legs and said couplings, whereby the resulting elevation of said helmet above said mounting surface may be adjusted using longer or shorter leg extensions.

14. The protective helmet apparatus as defined in claim 11 wherein said mount additionally comprises, a mirrored surface affixed to said mounting plate, thereby providing a means for upright individuals standing adjacent to said protective helmet apparatus to view the ocular area of the patients face reflected in the mirrored surface by looking downward at said mirrored surface.

15. The protective helmet apparatus as defined in claim 13 further comprising a means for angular adjustment of said mirrored surface in relation to said mounting plate, whereby the angle of said mirrored surface may be adjusted to the optimum angle for viewing said ocular area.

16. The protective helmet apparatus as defined in claim 13 further comprising a means for illumination, said means for illumination attached to one of said helmet casing or said mounting plate, said means for illumination positioned to illuminate the face of said patient.

17. The protective helmet apparatus as defined in claim 3 further comprising:

means for heating the head of the patient attachable to said helmet casing.

18. The protective helmet apparatus as defined in claim 17 wherein said means for heating the head of a patient, is an electrical resistive heating element, attached to the interior surface of said helmet casing.

19. The protective helmet apparatus as defined in claim 17 wherein said means for heating the head of a patient is an electrical resistive heating element mounted on a blanket which is attachable to one of said upper edges of said casing side walls, whereby said blanket may be folded over the patients head when said head is operatively occupying said protective helmet apparatus.

20. The protective helmet apparatus as defined in claim 3 wherein said helmet casing is constructed of substantially transparent material thereby affording a view into the ocular cushion aperture through the sidewall and front wall surfaces of the helmet casing.

21. The protective helmet apparatus as defined in claim 3 additionally comprising at least one tube passageway communicating through said helmet casing.

22. The protective helmet apparatus as defined in claim 3 wherein said helmet casing is adhered to said exterior surface of said cushion into a unitary structure.

23. The protective helmet apparatus as defined in claim 3 additionally comprising:

means for height adjustment of said helmet casing above said mounting surface.

* * * * *

US006490737C1

(12) INTER PARTES REEXAMINATION CERTIFICATE (0420th)

United States Patent
Mazzei et al.

(10) Number: US 6,490,737 C1
(45) Certificate Issued: Aug. 14, 2012

(54) PROTECTIVE CUSHION AND COOPERATIVELY ENGAGEABLE HELMET CASING FOR ANESTHETIZED PATIENT

(75) Inventors: William Mazzei, San Diego, CA (US); Gregory P. Jordan, Carlsbad, CA (US); An P. Vu, Vista, CA (US)

(73) Assignee: Dupaco, Inc., Oceanside, CA (US)

Reexamination Request:
No. 95/000,046, Jun. 5, 2004

Reexamination Certificate for:

| | |
|---|---|
| Patent No.: | **6,490,737** |
| Issued: | **Dec. 10, 2002** |
| Appl. No.: | **09/545,794** |
| Filed: | **Apr. 9, 2000** |

Related U.S. Application Data

(63) Continuation-in-part of application No. 09/080,975, filed on May 19, 1998, now Pat. No. 6,112,333.

(51) Int. Cl.
*A42B 3/00* (2006.01)
*A47C 20/00* (2006.01)

(52) U.S. Cl. ..... 2/410; 2/9; 5/638; 5/640; 128/846

(58) Field of Classification Search ..... 2/9, 2/11, 410, 411, 417, 424; 128/845, 846, 857, 128/858; 5/638, 639, 640, 643, 622; 602/17
See application file for complete search history.

(56) References Cited

To view the complete listing of prior art documents cited during the proceeding for Reexamination Control Number 95/000,046, please refer to the USPTO's public Patent Application Information Retrieval (PAIR) system under the Display References tab.

*Primary Examiner*—Jeffrey R. Jastrzab

(57) ABSTRACT

A protective helmet apparatus of modular construction to be worn by anesthetized patients for facial support during surgery. The helmet apparatus is assembled using one of a plurality of interchangeable, substantially transparent helmet casings, which are removably attachable to a plurality of dismountable facial cushions providing even support to the facial surface of a patient. The removable facial cushions are dimensioned on and interior surface to accommodate different sized facial structures of different patients to yield maximum pressure diffusion on the face and chin of the patient and are replaceable when worn. The exterior surface of the facial cushions are dimensioned for cooperative engagement with the interior surface of the helmet casing. A plurality of different facial cushions and helmet casings are modular in design and dimension to be interchangeable with each other thus providing accommodate the broad differences in facial structure and size of patients using them for surgery. The cushions may be marked with printed or color coded indicia to designate size. A view of the patients eyes and surrounding area is afforded through in line ocular apertures extending around a front surface area and up at least one sidewall. The ocular aperture is in line with a cushion ocular aperture when the cushion is engaged with the casing thereby allowing a view of the patent eye and surrounding face through the ocular aperture from the side of the device. Additional utility is provided by variable elevation above a registered engagement with a mount which also may provide a mirrored surface to reflect the patent facial features for viewing by upright doctors and operating staff. An optional integral heating element aids in temperature control of the patient's head during surgery.

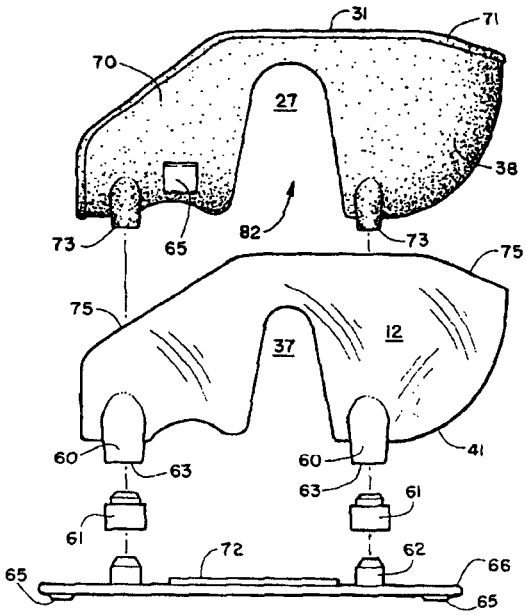

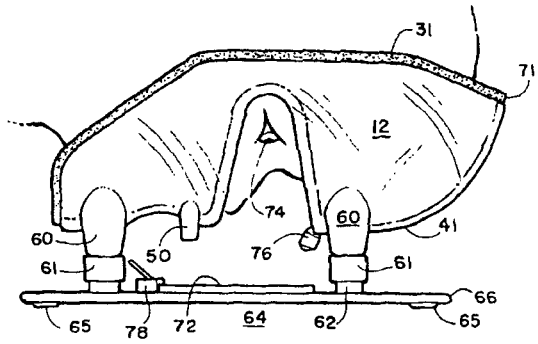

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2-23 is confirmed.

Claim 1 is cancelled.

New claims 24-39 are added and determined to be patentable.

*24. The protective helmet apparatus as defined in claim 2, wherein the facial cushion is one piece.*

*25. The protective helmet apparatus as defined in claim 1, wherein the facial cushion is one piece.*

*26. A protective helmet apparatus comprising:*

*a facial cushion for providing cranial support during surgery for an anesthetized patient in a prone position, which facial cushion may be assembled from a plurality of cooperatively engageable components of differing dimensions for achieving optimum fit and pressure diffusion upon the face of the intended helmet wearer, said facial cushion having a front portion and two cushion sidewalls extending upward from said front portion, said facial cushion having an interior surface and an exterior surface;*

*said interior surface of said facial cushion dimensioned to accommodate the facial structure of a human being;*

*at least one cushion ocular aperture in said facial cushion communicating laterally across said front portion and continuing up both of said two cushion sidewalls, said ocular aperture providing communication between said interior surface and said exterior surface;*

*a viewing passage formed by said cushion ocular aperature, said viewing passage providing a view through said cushion sidewalls, wherein one of the two eyes of a patient wearing said facial cushion while in the prone position, may be seen through said viewing passage from a position adjacent to either of said two cushion sidewalls, thereby allowing both of said patients eyes to be viewed through said viewing passage;*

*a helmet casing for use in combination with said facial cushion, said helmet casing having a casing front wall and two casing sidewalls, each of said casing sidewalls attached at a first edge to said casing front wall and extending generally vertically therefrom to an upper edge of said sidewalls, said helmet casing having a casing interior surface and a casing exterior surface;*

*at least one casing ocular aperture in said helmet casing communicating between said casing interior surface and said casing exterior surface, said casing ocular aperture shaped substantially similar to said cushion ocular aperture, and positioned in said helmet casing to substantially align with said cushion ocular aperture when said facial cushion is in cooperative engagement with said helmet casing, whereby either of said eyes of a patient wearing said cushion may be seen through the respective adjacent casing sidewall of said helmet casing when said facial cushion is in said cooperative engagement with said helmet casing;*

*wherein said exterior surface of said facial cushion is dimensioned for cooperative engagement with the interior of said helmet casing and wherein said facial cushion is interchangeably positionable to either one of a first position cooperatively engaged with said helmet casing or a second position with said exterior surface of said facial cushion supported on a mounting surface, whereby said facial cushion may be used either in said first position or said second position to provide support to the head of a patient undergoing surgery.*

*27. The protective helmet apparatus as defined in claim 26 in combination with:*

*a mirrored surface on said mounting surface to provide a means for upright individuals standing adjacent to said protective helmet apparatus to view the ocular area of the patients face reflected in the mirrored surface by looking downward at said mirrored surface while the patient wearing said supported cushion is in the prone position.*

*28. The protective helmet apparatus as defined in claim 26, wherein the facial cushion is one piece.*

*29. A protective helmet apparatus comprising:*

*a facial cushion for providing cranial support during surgery for an anesthetized patient in a prone position, which facial cushion may be assembled from a plurality of cooperatively engageable components of differing dimensions for achieving optimum fit and pressure diffusion upon the face of the intended helmet wearer, said facial cushion having a front portion and two cushion sidewalls extending upward from said front portion, said facial cushion having an interior surface and an exterior surface;*

*said interior surface of said facial cushion dimensioned to accommodate the facial structure of a human being;*

*at least one cushion ocular aperture in said facial cushion communicating laterally across said front portion and continuing up both of said two cushion sidewalls, said ocular aperture providing communication between said interior surface and said exterior surface; and*

*a viewing passage formed by said cushion ocular aperture, said viewing passage providing a view through said cushion sidewalls, wherein one of the two eyes of a patient wearing said facial cushion while in the prone position, may be seen through said viewing passage from a position adjacent to either of said two cushion sidewalls, thereby allowing both of said patients eyes to be viewed through said viewing passage;*

*in combination with a mirrored surface on a mounting surface that supports said exterior surface of said facial cushion, wherein said mirrored surface provides a means for upright individuals standing adjacent to said protective helmet apparatus to view the ocular area of the patients face reflected in the mirrored surface by looking downward at said mirrored surface while the patient wearing said cushion is in the prone position.*

*30. The protective helmet apparatus and mirrored surface combination as defined in claim 29 further comprising:*

*means for height adjustment of said protective helmet apparatus above said mirrored surface.*

*31. The protective helmet apparatus and mirrored surface combination as defined in claim 29, wherein the facial cushion is one piece.*

*32. A protective helmet apparatus comprising:*

*a facial cushion for providing cranial support during surgery for an anesthetized patient in a prone position, which facial cushion may be assembled from a plurality of cooperatively engageable components of differing dimensions for achieving optimum fit and pressure diffusion upon the face of the intended helmet wearer, said facial cushion having a front portion and two cushion sidewalls extending upward from said front portion, said facial cushion having an interior surface and an exterior surface;*

*said interior surface of said cushion dimensioned to accommodate the facial structure of a human being;*

*at least one cushion ocular aperture in said cushion communicating laterally across said front portion and continuing up both of said two cushion sidewalls, said ocular aperture providing communication between said interior surface and said exterior surface;*

*a viewing passage formed by said cushion ocular aperture, said viewing passage providing a view through said cushion sidewalls, wherein one of the two eyes of a patient wearing said cushion while in the prone position, may be seen through said viewing passage from a position adjacent to either of said two cushion sidewalls, thereby allowing both of said patient's eyes to be viewed through said viewing passage; and*

*wherein said exterior surface of said cushion is dimensioned for cooperative engagement with the interior of a helment casing wherein said cushion is interchangeably positionable to either one of a first position cooperatively engaged with a helmet casing or a second position with said exterior surface of said cushion supported on a mounting surface, whereby said cushion may be used either in said first position or said second position to provide support to the head of a patient undergoing surgery.*

*33. The protective helmet apparatus as defined in claim 32, wherein the facial cushion is one piece.*

*34. The protective helmet apparatus as defined as in claim 32 in combination with:*

*a mirrored surface on said mounting surface to provide a means for upright individuals standing adjacent to said protective helmet apparatus to view the ocular area of the patients face reflected in the mirrored surface by looking downward at said mirrored surface while the patient wearing said cushion is in the prone position.*

*35. The protective helmet apparatus as defined in claim 34 further comprising:*

*means for height adjustment of said protective helmet apparatus above said mirrored surface.*

*36. A protective helmet apparatus comprising:*

*a facial cushion for providing cranial support during surgery for an anesthetized patient in a prone position, which facial cushion may be assembled from a plurality of cooperatively engageable components of differing dimensions for achieving optimum fit and pressure diffusion upon the face of the intended helmet wearer, said facial cushion having a front portion and two cushion sidewalls extending upward from said front portion, said facial cushion having an interior surface and an exterior surface;*

*said interior surface of said cushion dimensioned to accommodate the facial structure of a human being;*

*at least one cushion ocular aperture in said cushion communicating laterally across said front portion and continuing up both of said two cushion sidewalls, said ocular aperture providing communication between said interior surface and said exterior surface;*

*a viewing passage formed by said cushion ocular aperture, said viewing passage providing a view through said cushion sidewalls, wherein one of the two eyes of a patient wearing said cushion while in the prone position, may be seen through said viewing passage from a position adjacent to either of said two cushion sidewalls, thereby allowing both of said patient's eyes to be viewed through said viewing passage; and*

*wherein the facial cushion is one piece.*

*37. A method, comprising the steps of:*

*(a) providing cranial support during surgery for an anesthetized patient in a prone position by fitting the patient with a protective helmet apparatus which may be assembled from a plurality of cooperatively engageable components of differing dimensions for achieving optimum fit and pressure diffusion upon the face of the intended helmet wearer, the facial helmet apparatus comprising: a facial cushion, said facial cushion having a front portion and two cushion sidewalls extending upward from said front portion, said facial cushion having an interior surface and an exterior surface; said interior surface of said facial cushion dimensioned to accommodate the facial structure of a human being; at least one cushion ocular aperture in said facial cushion communicating laterally across said front portion and continuing up both of said two cushion sidewalls, said ocular aperture providing communication between said interior surface and said exterior surface; and a viewing passage formed by said cushion ocular aperture, said viewing passage providing a view through said cushion sidewalls, wherein one of the two eyes of a patient wearing said facial cushion while in the prone position, may be seen through said viewing passage from a position adjacent to either of said two cushion sidewalls, thereby allowing both of said patients eyes to be viewed through said viewing passage;*

*(b) supporting said exterior surface of said facial cushion on a mounting surface; and*

*(c) providing a mirrored surface on the mounting surface to provide a means for upright individuals standing adjacent to said protective helmet apparatus to view the ocular area of the patients face reflected in the mirrored surface by looking downward at said mirrored surface while the patient wearing said cushion is in the prone position.*

*38. The method as defined in claim 37 further comprising the step of:*

*adjusting the height of said protective helmet apparatus above said mirrored surface.*

*39. The method as defined in claim 37, wherein the facial cushion is one piece.*

* * * * *